US006561874B1

(12) United States Patent
Kordonski

(10) Patent No.: US 6,561,874 B1
(45) Date of Patent: May 13, 2003

(54) APPARATUS AND METHOD FOR ABRASIVE JET FINISHING OF DEEPLY CONCAVE SURFACES USING MAGNETORHEOLOGICAL FLUID

(75) Inventor: William I. Kordonski, Webster, NY (US)

(73) Assignee: QED Technologies, Inc, Rochester, NY (US)

( * ) Notice: Subject to any disclaimer, the term of this patent is extended or adjusted under 35 U.S.C. 154(b) by 313 days.

(21) Appl. No.: 09/718,658

(22) Filed: Nov. 22, 2000

(51) Int. Cl.[7] ..... B24B 1/00

(52) U.S. Cl. ..... 451/38; 451/9; 451/36; 451/60; 451/91

(58) Field of Search ..... 451/38, 36, 9, 451/60, 91

(56) References Cited

U.S. PATENT DOCUMENTS 5,839,944 A * 11/1998 Jacobs et al. ..... 451/8
5,951,369 A * 9/1999 Kordonski et al. ..... 451/5
5,971,835 A * 10/1999 Kordonski et al. ..... 451/38
6,106,380 A * 8/2000 Jacobs et al. ..... 451/360
6,332,829 B1 * 12/2001 Trommer ..... 451/28

* cited by examiner

*Primary Examiner*—Joseph J. Hail, III
*Assistant Examiner*—Alvin J. Grant
(74) *Attorney, Agent, or Firm*—Neal L. Slifkin; Harris Beach LLP

(57) ABSTRACT

Apparatus and method for abrasive jet of a deeply concave surface using magnetorheological fluid. A ferromagnetic nozzle recessed within a solenoid magnetically shields the fluid within the nozzle and serves as a core for the solenoid, thereby increasing the strength of the magnetic field approximately 100-fold, permitting a significant reduction in the size of the solenoid. The exit orifice of the nozzle is recessed within the solenoid, creating a free space within the solenoid having an intense, shaped, axial magnetic field in and near the nozzle. Stiffening of the magnetorheological fluid begins as the fluid enters the magnetic field upon leaving the nozzle; thus, there is no buildup of viscous drag through the nozzle. Stiffening of the jet occurs principally in free space within the solenoid. The nozzle has peripheral longitudinal channels through which compressed air is conveyed to form an air curtain surrounding the jet, preventing spent MR fluid from re-entering and fouling the nozzle.

10 Claims, 6 Drawing Sheets

APPARATUS AND METHOD FOR ABRASIVE JET FINISHING OF DEEPLY CONCAVE SURFACES USING MAGNETORHEOLOGICAL FLUID

BACKGROUND OF THE INVENTION

1. Field of the Invention

The present invention relates to methods and apparatus for shaping and polishing (finishing) a surface; more particularly to methods and apparatus for shaping and polishing a surface by the impingement of a magnetically-modifiable and magnetically-directable jet; and most particularly to a magnetically-efficient nozzle for extruding a jet of magnetically-solidified magnetorheological fluid in an upwards direction.

2. Discussion of the Related Art

Fluid jets containing abrasive particles are known to be used for cutting or shaping materials such as glass, ceramics, plastics and metals. This technology is known generally as abrasive stream finishing, or abrasive suspension jet machining, or abrasive flow machining. Typically, such jets are impinged upon the substrate to be cut at a relatively high velocity, which may exceed 10 meters per second. When the jet strikes the impact zone, the abrasive particles in the fluid chip away particles of the substrate surface. The rate of material removal is a function of the kinetic energy of the jet, the sharpness, size, and hardness of the abrasive particles, the material of the substrate, the distance from the jet nozzle to the workpiece, and the angle of incidence of the jet.

In U.S. Pat. No. 5,971,835 issued Oct. 26, 1999 to Kordonski et al., the relevant disclosure of which is hereby incorporated by reference, a technology is disclosed by which a magnetorheological (MR) fluid may be formed into a substantially coherent abrasive jet. A continuous stream of an MR fluid is directed through a non-ferromagnetic tube disposed axially of the helical windings of an electric solenoid. The tube defines a nozzle. Preferably, the MR fluid is combined with a finely-divided abrasive material, for example, cerium oxide, diamond dust, or iron oxide, such that the abrasive is at least temporarily suspended therein. Flow of electricity through the solenoid creates an axial magnetic field within the windings which forms in the fluid a field-oriented structure of fibrils from the magnetic particles and thereby reversibly stiffens the flowing MR fluid into a virtually solid rod. The rod manifests a very high yield stress when sheared perpendicularly to the direction of flow and a relatively low shear stress when sheared in the direction of flow, as along the wall of the tube. Such anisotropic fibrillation allows the stiffened fluid to flow through the tube in the magnetic field. The MR rod ejected from the nozzle defines a highly-collimated, substantially solid jet of MR fluid. Upon leaving the nozzle, the exit of which is flush with the end of the windings, the MR fluid jet passes beyond the solenoid's magnetic field, and the anisotropic fibrillation within the jet begins to decay. However, remanent high viscosity, and thus consequent stabilization of the MR jet, can persist for a sufficient time that the jet may travel up to several feet without significant spreading and loss of structure. This permits use of the abrasive jet to shape and/or polish the surface of a workpiece in a work zone at some distance from the nozzle.

At least three serious problems can arise in regard of the prior art apparatus.

First, the prior art apparatus is not suited to finishing deeply concave surfaces. Because of splashing, pooling, and gravitational effects, we have found that the optimal finishing attitude for the abrasive jet is directly upwards. However, some of the spent MR fluid rebounding from the surface of the workpiece falls back onto the solenoid and nozzle, clogging the exit and subsequently deforming the jet.

Second, the nozzle is a non-ferromagnetic axial tube in which the magnetorheological fluid is stiffened progressively as it flows through the nozzle, creating a progressively increasing viscous drag in the nozzle which must be overcome by the system's pump. Thus, the pump and energy requirements for the prior art apparatus can become substantial.

Third, because the solenoid lacks a ferro-magnetic core, the axial magnetic field is relatively weak, requiring an undesirably large and expensive solenoid.

What is needed is a magnetorheological finishing apparatus which can direct a stiffened jet in any direction, and especially in an upwards direction, continuously without becoming fouled by reflected fluid; which has a small pump by virtue of developing minimal viscous drag in delivery of the stiffened jet; and which has a small, magnetically-efficient solenoid by virtue of having a ferromagnetic solenoid core.

It is a primary objective of the invention to provide means for delivering a jet of solidified magnetorheological fluid for abrasive finishing of deeply concave substrates.

It is a further object of the invention to provide a compact abrasive finishing apparatus having a small, inexpensive pumping system and a small solenoid.

SUMMARY OF THE INVENTION

Briefly described, in an apparatus for abrasive jet shaping and polishing of a surface using magnetorheological fluid, similar to the apparatus disclosed in U.S. Pat. No. 5,971,835, the non-ferromagnetic nozzle (shown as item 30 therein) within the solenoid is replaced by a nozzle formed of ferromagnetic material such that the fluid is magnetically shielded within the nozzle. The improved nozzle serves as a ferromagnetic core for the solenoid, thereby increasing the strength of the axial magnetic field approximately 100-fold and permitting a significant reduction in the required size of the solenoid. The exit orifice of the nozzle is recessed within the solenoid turnings, rather than being flush with the end of the solenoid as in the prior art apparatus, thus creating a free space within the solenoid having an intense axial magnetic field near the exit orifice of the nozzle. Stiffening of the magnetorheological fluid is prevented substantially throughout the length of the nozzle until the fluid begins to enter the magnetic field as it leaves the nozzle; thus, there is no buildup of viscous drag through the nozzle. Formation of fibrils and consequent stiffening of the jet occurs principally in free space within the windings of the solenoid. The exit end of the nozzle is configured so that the magnetic field at the end of the nozzle and in the free space immediately downstream of the exit is intensified and collimated. Further, the nozzle is provided with a radial array of longitudinal channels along its outer surface through which compressed air is injected to form a cylindrical air curtain which surrounds the jet as it emerges from the nozzle and solenoid. Returning MR fluid splashed from the workpiece is diverted by the air curtain and prevented from entering and fouling the solenoid exit and nozzle.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DETAILED DESCRIPTION OF THE INVENTION

Figure 1:
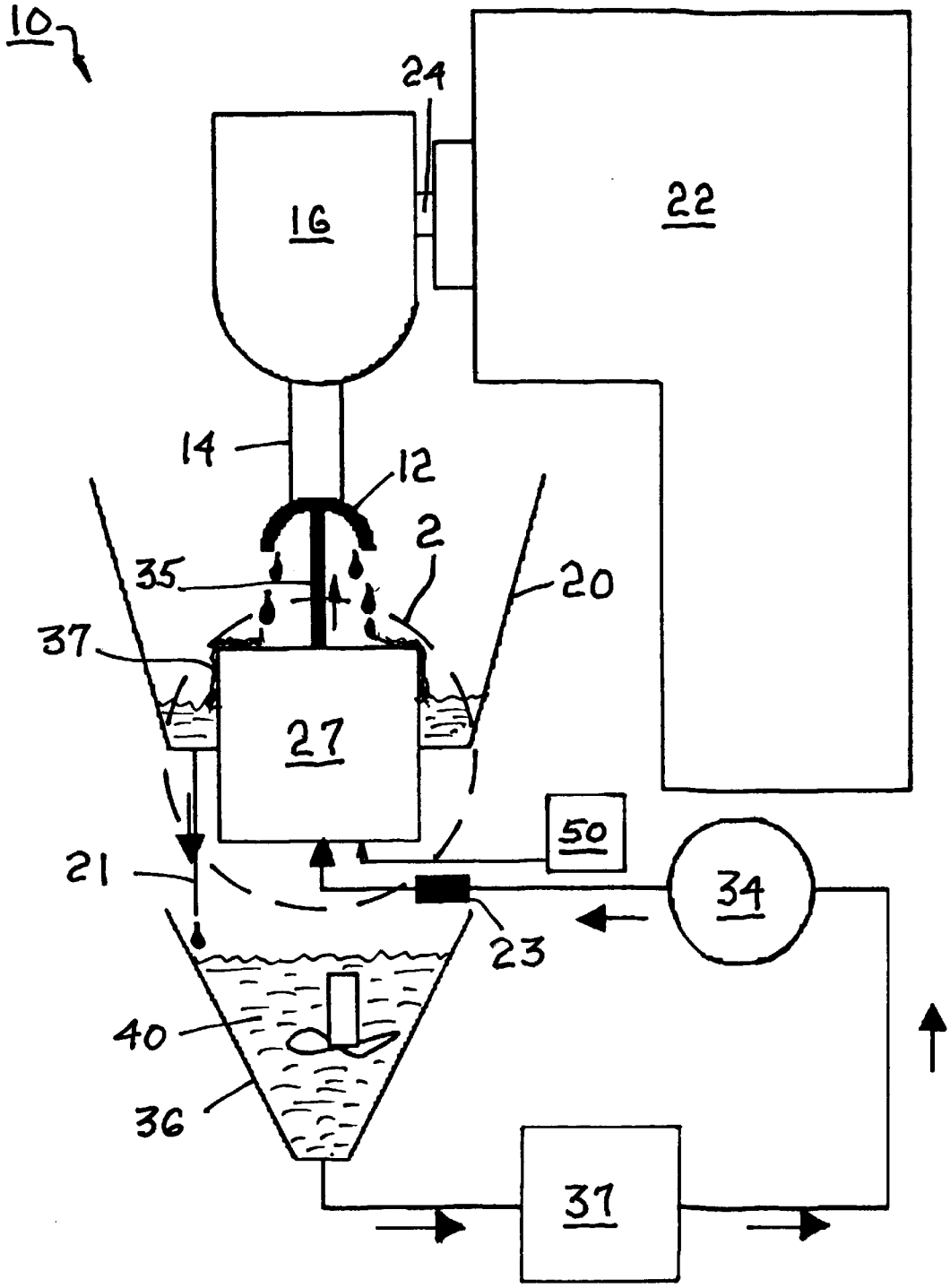
FIG. 1 is a partially schematic, cross-sectional, elevational view of a magnetorheological polishing apparatus in accordance with the invention, showing the apparatus in use in finishing a deeply concave surface.
Figure 2:
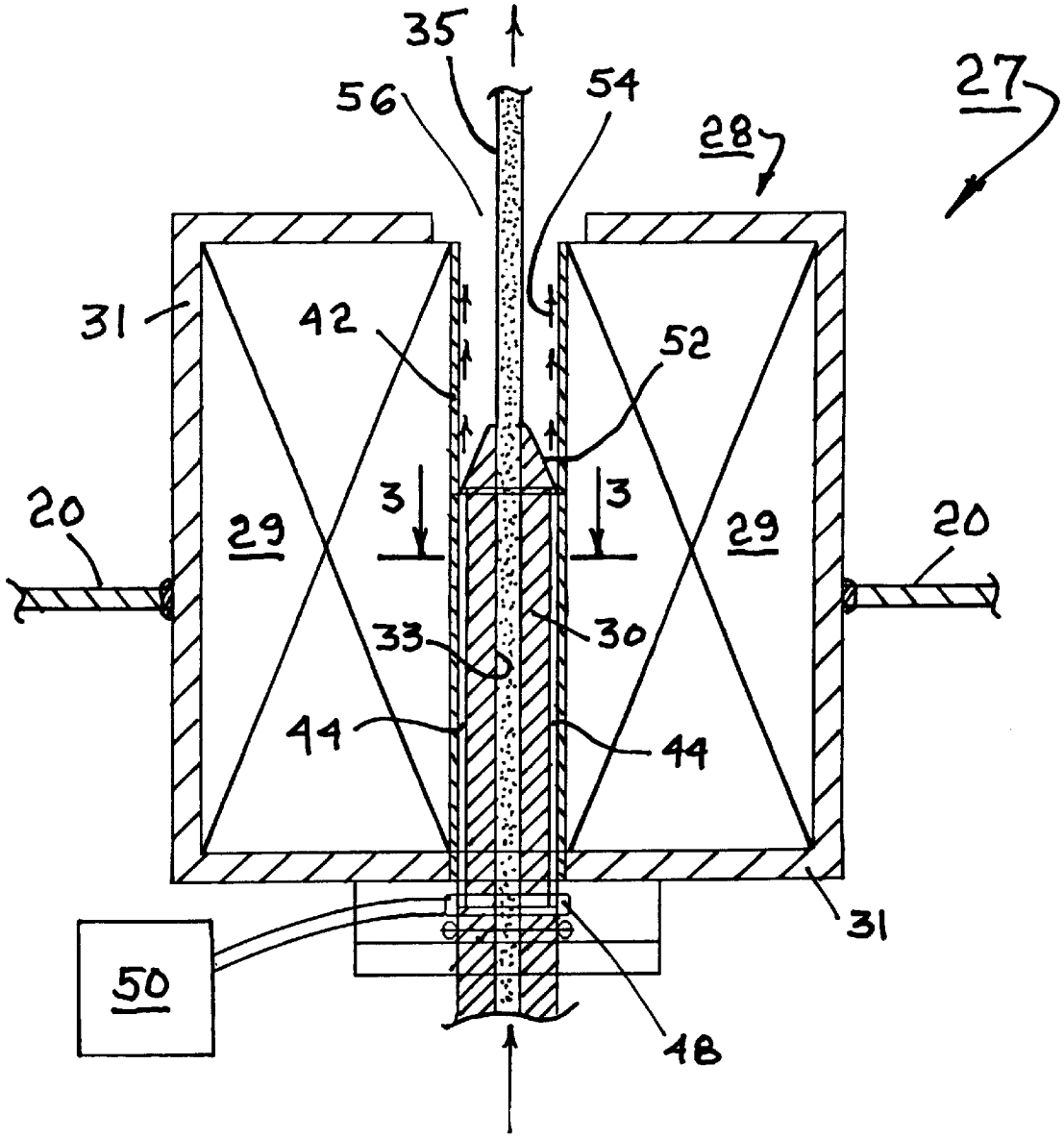
FIG. 2 is a detailed cross-sectional view taken within circle 2 in FIG. 1, showing a field-shaping nozzle in accordance with the invention disposed axially within the solenoid windings.
Figure 3:
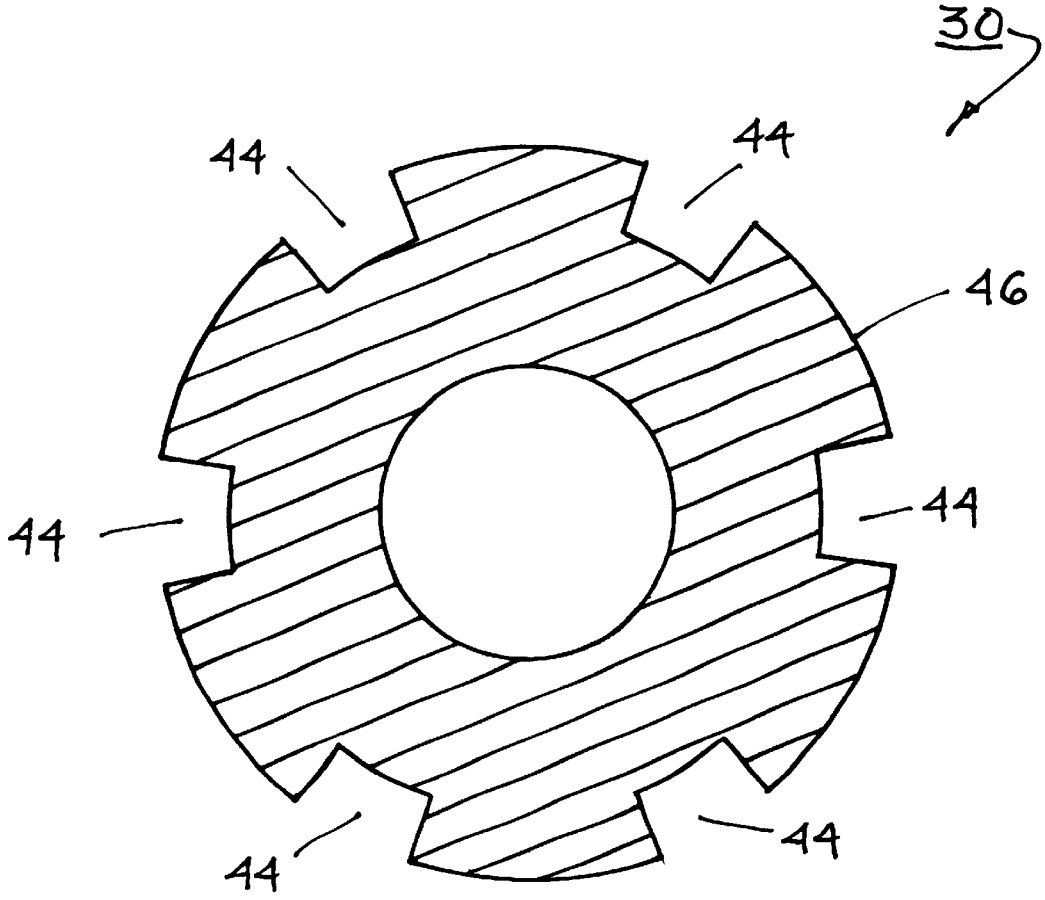
FIG. 3 is a cross-sectional view of the shaping nozzle taken along line 3—3 in FIG. 2.

Referring to FIGS. 1–3, an embodiment 10 of a polishing apparatus in accordance with the invention for finishing a substrate by vertically upwards abrasive jet comprises many of the elements disclosed in U.S. Pat. No. 5,971,835 except as modified below. A workpiece 12 to be finished, for example, a molded blank for a glass or plastic lens or other optical element, or a similar metal or ceramic element requiring a very high level of accuracy in its final shape and the smoothness of its surface, and especially a deeply concave surface, is mounted in a supportive chuck 14, which in turn is supported for rotation in a machine spindle 16. The workpiece and chuck are surrounded by a shroud 20 which serves as a supportive housing and shield for the finishing operations. Outside the shroud is a multi-axis positioner 22, for example, a 5-axis CNC machine available from Boston Digital Corp., Milford, Mass. USA, the output shaft 24 of which is connected to machine spindle 16.

Mounted in a central aperture in the bottom of shroud 20 is a magnetic field-shaping subsystem 27 for forming a stiffened jet of magnetorheological fluid, as shown in detail in. FIG. 2. An electric solenoid 28 capable of generating an axial magnetic field of, for example, about 1000 gauss is mounted such that an extension of the solenoid's axis in space intersects a portion of the surface to be finished on workpiece 12. Preferably, the electric current provided to solenoid 28 may be varied to vary the strength of the magnetic field as desired. Solenoid 28 is wound conventionally with electrically conductive windings 29 preferably contained within a magnetically opaque shell 31 formed of, for example, steel.

Solenoid 28 is provided along a portion of its axial length with an improved shaping nozzle 30, as described in detail below, which comprises the novel improvement of the present invention and which extends partially into the axial space in the solenoid. A pump 34 is connected for fluid flow between a fluid reservoir 36 and nozzle 30 to eject a collimated jet 35 of fluid from the nozzle. A pulse dampener 33 may be optionally included for suppressing pulses from pump 34. Preferably, a controllable cooling means 37, which may be disposed within reservoir 36, is provided to temper the working fluid. Reservoir 36 contains an amount of a magnetorheological fluid 40 which preferably includes a finely-divided abrasive material such as, for example, cerium oxide, diamond dust, alumina, or combinations thereof. Spent MR fluid 37 flowing off of workpiece 12 collects in the bottom of shroud 20 and flows by gravity through an outlet tube 21 back into reservoir 36 for re-use, as shown in FIG. 1.

We have found, surprisingly, in operating the prior art shaping apparatus shown in the incorporated reference, that the magnetorheological fluid becomes stiffened very quickly and over only a very short portion of its travel through the prior art nozzle. This surprising discovery opens the possibility of forming most if not all of the stiffening of the fluid in free space within the windings of the solenoid after ejecting the fluid from the end of a nozzle, provided that a) the fluid is shielded from the magnetic field during passage through the nozzle; b) the nozzle tip is shaped to appropriately concentrate and shape the magnetic field; and c) the tip is recessed from the outer end of the solenoid windings such that an intensified axial magnetic field is present in the free space for stiffening the fluid, all in accordance with the invention. Such stiffening in free space permits the use of a ferromagnetic material in construction of the nozzle, thereby providing a ferromagnetic core to solenoid 28, and eliminates the viscous drag experienced in the prior art apparatus caused by stiffening of fluid within the nozzle. The tip is recessed into the solenoid windings by a distance equal to at least the diameter of the nozzle, and preferably between one and four times such diameter.

Shaping nozzle 30 is a tubular, generally cylindrical member having an axial bore 33 and an outer diameter substantially the same as the inner diameter of an optional tubular solenoid liner 42 which supports the windings 29 of solenoid 28 and in which nozzle 30 is disposed. The nozzle is formed of a ferromagnetic material such as, for example, carbon steel, such that MR fluid flowing through the tube is shielded from the solenoid's magnetic field. Liner 42 is formed of a ferromagnetically transparent material, for example, copper or stainless steel. Nozzle 30 preferably is provided with a plurality of longitudinal passageways 44 formed in the outer surface 46 of nozzle 30, which passageways terminate at a first end in a plenum 48 which is operationally attached to a conventional high-pressure air supply 50 for supplying air through the passageways during operation of apparatus 10. The passageways terminate at a second end around the periphery of the outer end 52 of shaping nozzle 30 such that a substantially cylindrical curtain of air 54 is formed and caused to flow axially from end 52 along the inner wall of sleeve 42 toward the open end 56 of liner 42. Air curtain 54 fills the space between jet 35 and liner 42 and continually flows out of the solenoid without disturbing jet 35. Spent MR fluid splashing or dripping from workpiece is deflected by the air curtain from entering the solenoid and fouling the continued delivery of jet 35, permitting continuous operation of apparatus 12.

In operation, MR fluid 40, which has a low inherent viscosity, is drawn from reservoir 36 by pump 34 and pumped through nozzle 30. As the MR fluid enters the solenoid axial magnetic field at the exit of the nozzle, the magnetic moments of the magnetic particles become aligned to form fibrils, inducing a rod-like structure in the fluid. The fluid becomes highly stiffened to a physical texture like wet clay, and the apparent viscosity across the direction of flow becomes very high. The fluid is ejected from the nozzle in the direction of the workpiece as highly collimated jet 35. Because the end 52 of nozzle 30 is recessed within the solenoid, as shown in FIGS. 1 and 2, the jet continues to be stiffened during passage through the axial magnetic field after leaving nozzle. Because the cylindrical air curtain 54 surrounding the jet is travelling at a velocity comparable to that of the jet, the outer surface of the jet undergoes little or no degradation from aerodynamic turbulence.

Figure 4:
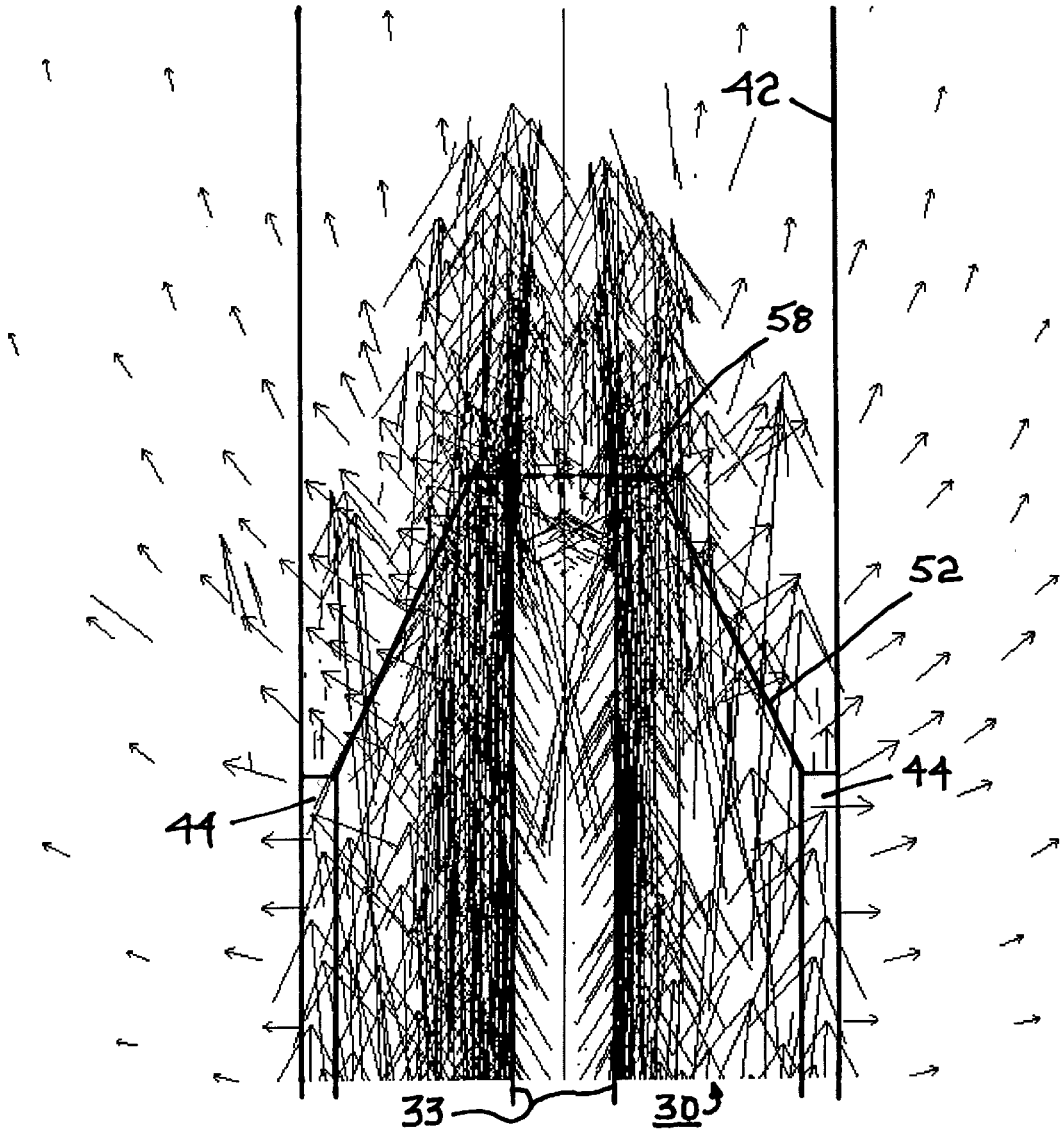
FIG. 4 is a cross-sectional view of the shaping nozzle within the solenoid, showing the strength and direction of the magnetic field in and around the field-shaping nozzle.
Figure 5:
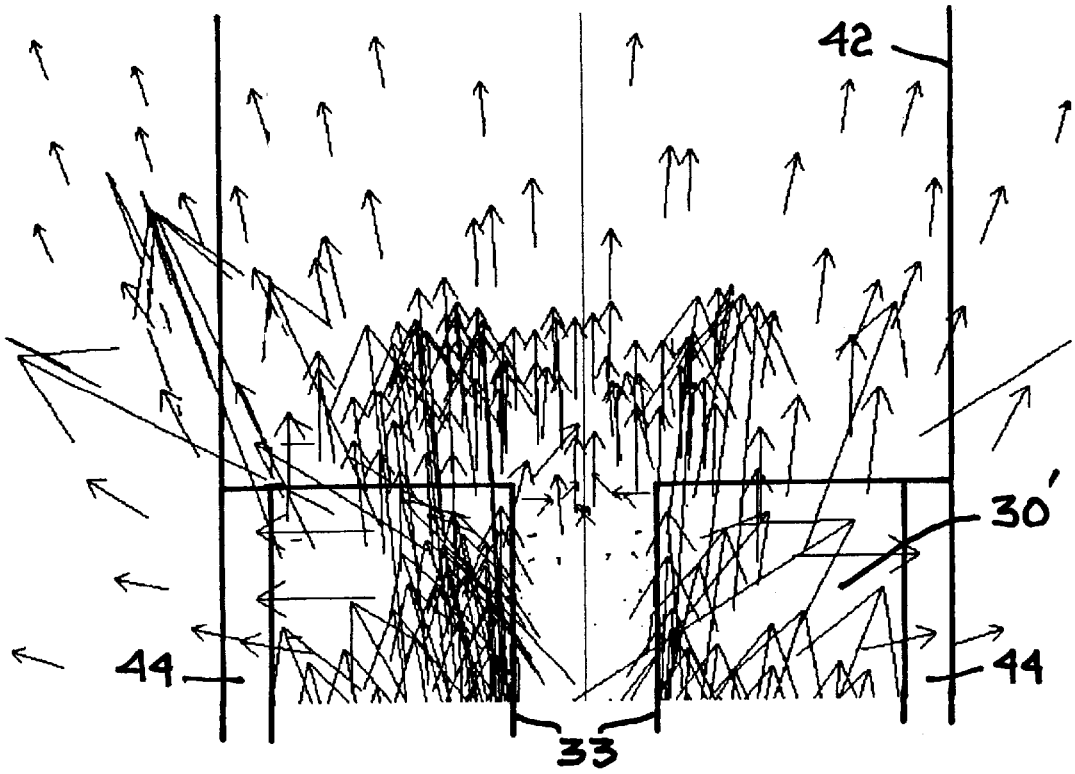
FIG. 5 is a cross-sectional view like that shown in FIG. 4, showing the strength and direction of the magnetic field in a flush-ended, non-shaping nozzle not in accordance with the invention.

The protuberant end 52 of nozzle 30 is an important feature of the present invention. Referring to FIG. 4, protuberant end 52 is tapered from outer surface 46 toward bore 33, which taper acts to concentrate, collimate, and shape the magnetic field in the vicinity of tip 58 of end 52. As shown in FIG. 5, a nozzle which is otherwise identical but which has a non-protuberant flush end provides a comparatively weak and gradually divergent magnetic field inferior to that achievable with a protuberant nozzle tip.

Figure 7:
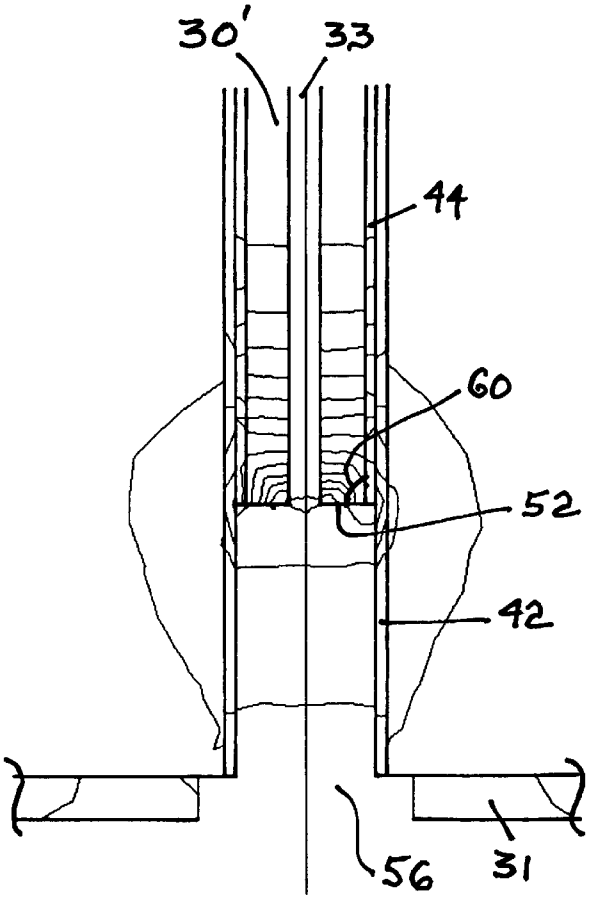
FIG. 7 is a view like that shown in FIG. 6, showing isoflux lines for the flush-ended non-shaping nozzle shown in FIG. 5.
Figure 6:
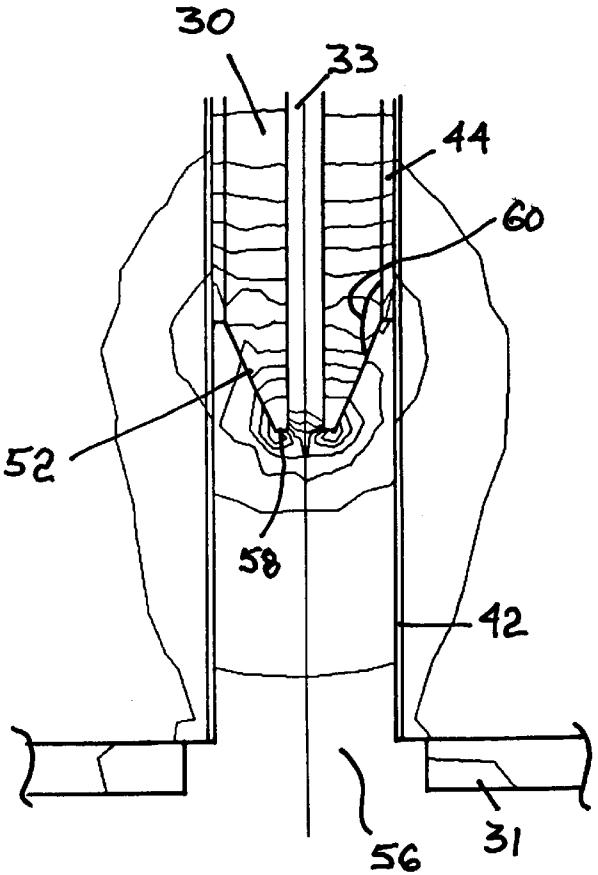
FIG. 6 is a cross-sectional view similar to that shown in FIG. 4, showing isoflux lines (of equal magnetic field strength) for a field-shaping nozzle in accordance with the invention.

Referring to FIGS. 6 and 7, the importance of making the end 52 protuberant from the cylindrical barrel of the nozzle is further demonstrated by comparison of isoflux representations of protuberant 30 and non-protuberant 301 nozzle tips. While all protuberant longitudinal cross-sectional shapes, including, but not limited to, spherical, elliptical, and conical, are within the scope of the invention, the currently-preferred shape is frusto-conically tapered. A flush end to the nozzle (0° angle of taper, or 90° included angle 60), as shown in FIG. 7, cannot concentrate and shape the magnetic field around and beyond the tip of the nozzle, as shown for a tapered end 52 in FIG. 6. The angle of taper 60 may be varied to suit individual applications; an included angle of about 150°, as shown in FIG. 6, has been found to provided substantial shaping and narrowing of the jet. For structural reasons, the nozzle may be provided as frusto-conical with a small flat end 58 to the cone.

As noted above, nozzle 30 is formed of a ferromagnetic material such as iron or cold-rolled steel tubing, thereby providing a ferromagnetic core over much of the axial length of the solenoid. The axial magnetic field is strengthened thereby by as much as several orders of magnitude, permitting use of a very much smaller and less expensive solenoid than that disclosed in the incorporated reference. Although the core does not extend the full axial length of solenoid 28, and consequently the axial magnetic field in the non-core portion is relatively weak, the protuberant tip on nozzle 30 concentrates and shapes the field extending axially from the tip, permitting the desired stiffening to occur in free space within the solenoid.

Apparatus in accordance with the invention is especially useful in abrasive jet finishing of deeply concave surfaces when operated in a vertical mode as shown in FIG. 1. For finishing in other orientations, however, the present invention is still superior to that disclosed in the incorporated reference because of the smaller, less-expensive solenoid it allows. In some non-vertical applications, the air curtain feature of the invention may be omitted for economy if so desired.

From the foregoing description it will be apparent that there has been provided an improved system for abrasive-jet finishing of precision elements, wherein a magnetorheological fluid containing abrasive particles is ejected vertically upwards at a high velocity from a ferromagnetic field-shaping nozzle having a protuberant end, is stiffened to a high apparent viscosity in a solenoid's internal magnetic field, and impinged as a collimated jet upon the surface to be finished. Variations and modifications of the herein described magnetorheological abrasive jet finishing system, including the nozzle having a protuberant end in accordance with the invention, will undoubtedly suggest themselves to those skilled in this art. Accordingly, the foregoing description should be taken as illustrative and not in a limiting sense.

What is claimed is:

1. A method of making a coherent, substantially rigid fluid jet comprising the steps of:

a) providing an electric solenoid;

b) disposing axially within the windings of said solenoid at least a portion of a nozzle formed of a ferromagnetic material, said nozzle having a bore and a protuberant tip, said tip being recessed from an axial end of said solenoid to define a free axial space within said solenoid between said tip and said end;

c) providing a magnetorheological fluid;

d) energizing said solenoid to provide a magnetic field within said solenoid;

d) forcing said magnetorheological fluid through said ferromagnetic nozzle;

e) ejecting said fluid from said nozzle to form a jet of said fluid in said free space; and f) stiffening said fluid in the presence of said magnetic field to form said coherent, substantially rigid fluid jet, at least a portion of said stiffening occurring in said free space.

2. A method in accordance with claim 1 wherein said ejecting of said fluid is in a vertically upwards direction.

3. A method in accordance with claim 1 wherein said nozzle further comprises a plurality of longitudinal passageways formed in an outer surface of said nozzle for receiving air from a pressurized source, comprising the further steps of:

a) conveying the air in said passageways longitudinally of said nozzle, and b) discharging the air peripherally of said tip in said free space to form a generally cylindrical air curtain surrounding said jet.

4. A method in accordance with claim 1 wherein said tip is frusto-conical.

5. In a system for finishing a workpiece by impinging a stiffened magnetorheological jet thereupon, the system including an electric solenoid formed of a plurality of electrical windings about an axial space spaced apart from the workpiece and means for supplying magnetorheological fluid to the axial space, the improvement comprising a nozzle disposed within said axial space for receiving, collimating, and ejecting said magnetorheological fluid as a jet therefrom, said nozzle being formed of a ferromagnetic material to shield said fluid from being stiffened by the solenoid magnetic field while said fluid is within said nozzle, said nozzle having a protuberant tip for concentrating and shaping the magnetic field near and at said nozzle tip, said nozzle tip being recessed within said solenoid windings away from said workpiece to define a free space between said nozzle tip and an outer end of said axial space wherein at least a portion of said stiffening occurs.

6. A nozzle in accordance with claim 5 wherein the shape of said protuberant tip is selected from the group consisting of spherical, elliptical, conical, and frusto-conical.

7. A nozzle in accordance with claim 5 wherein said nozzle is generally cylindrical and wherein the depth of said recess is at least equal to the diameter of said nozzle.

8. A nozzle in accordance with claim 5 further comprising at least one longitudinal passageway formed in said nozzle for receiving air from a pressurized source, conveying the air longitudinally of said nozzle, and discharging the air peripherally of said tip in said free space.

9. A nozzle in accordance with claim 8 comprising a plurality of said longitudinal passageways, the discharged air forming a generally cylindrical air curtain.

10. A system for providing a stiffened jet of magnetorheological fluid, comprising:

a) a solenoid having a plurality of electrifiable windings about an axial space, said space having an axial entrance and an axial exit, said windings providing a magnetic field within said axial space;

b) a ferromagnetic nozzle disposed at least partially within said axial space for receiving, collimating, and ejecting said magnetorheological fluid as a jet therefrom, said nozzle having a protuberant tip for concentrating and shaping said magnetic field near and at said nozzle tip, said nozzle tip being recessed within said solenoid windings away from said workpiece to define a free space between said nozzle tip and said axial exit wherein at least a portion of said stiffening occurs; and c) pump means for providing said magnetorheological fluid to said nozzle.

* * * * *